US010107455B2

(12) United States Patent
Shaaban et al.

(10) Patent No.: US 10,107,455 B2
(45) Date of Patent: Oct. 23, 2018

(54) LNG VAPORIZATION

(71) Applicants: Khaled Shaaban, Houston, TX (US); Dinh Nguyen, Houston, TX (US)

(72) Inventors: Khaled Shaaban, Houston, TX (US); Dinh Nguyen, Houston, TX (US)

( * ) Notice: Subject to any disclaimer, the term of this patent is extended or adjusted under 35 U.S.C. 154(b) by 779 days.

(21) Appl. No.: 14/085,783

(22) Filed: Nov. 20, 2013

(65) Prior Publication Data

US 2015/0136043 A1 May 21, 2015

(51) Int. Cl.
*F24H 9/00* (2006.01)
*F17C 7/04* (2006.01)

(52) U.S. Cl.
CPC ..... *F17C 7/04* (2013.01); *F17C 2201/054* (2013.01); *F17C 2221/033* (2013.01); *F17C 2223/0161* (2013.01); *F17C 2223/033* (2013.01); *F17C 2225/0123* (2013.01); *F17C 2225/0161* (2013.01); *F17C 2227/0142* (2013.01); *F17C 2227/0302* (2013.01); *F17C 2227/039* (2013.01); *F17C 2227/0393* (2013.01); *F17C 2265/03* (2013.01); *F17C 2265/05* (2013.01)

(58) Field of Classification Search
CPC ..... F24H 9/00; F17C 2225/0123; F17C 2223/0161
See application file for complete search history.

(56) References Cited

U.S. PATENT DOCUMENTS 4,728,029 A * 3/1988 Griebel ..... B60H 1/22 122/26
5,081,977 A * 1/1992 Swenson ..... F02B 43/00 123/1 A
5,098,036 A * 3/1992 Brigham ..... B64F 5/23 122/26
5,375,580 A * 12/1994 Stolz ..... F02B 29/0443 123/527
5,590,535 A * 1/1997 Rhoades ..... F17C 9/02 62/50.2
5,656,136 A * 8/1997 Gayaut ..... E21B 33/068 166/302

(Continued)

OTHER PUBLICATIONS

CHI Mobile LNG Vaporizers (2013 print-out from Website).

(Continued)

*Primary Examiner* — Nathaniel Herzfeld
(74) *Attorney, Agent, or Firm* — Mark R. Wisner

(57) ABSTRACT

Apparatus and methods for vaporizing LNG while producing sufficient volume of compressed natural gas at sufficient pressure to meet the needs of internal combustion engines, gas turbines, or other high consumption devices operating on natural gas or on a mixture of diesel and natural gas. The LNG vaporizer of the present invention incorporates a reciprocating pump to provide vaporized LNG to an output at rates and pressures as required by the particular application. The heat rejected into the engine coolant and the exhaust stream from an artificially loaded internal combustion engine, as well as the hydraulic heat resulting from artificially loading the engine, is transferred to the LNG as the LNG passes through a heat exchanger. Exhaust heat is transferred to the engine coolant after the coolant passes through the heat exchanger.

5 Claims, 1 Drawing Sheet

(56) References Cited

U.S. PATENT DOCUMENTS

| | | | | |
|---|---|---|---|---|
| 5,771,946 | A * | 6/1998 | Kooy | F17C 6/00 141/11 |
| 5,988,280 | A | 11/1999 | Crawford | |
| 6,474,101 | B1 * | 11/2002 | Quine | F17C 7/04 62/50.2 |
| 6,691,925 | B2 * | 2/2004 | Roberts | B60H 1/14 122/26 |
| 7,424,916 | B2 | 9/2008 | Foster | |
| 9,228,760 | B2 * | 1/2016 | Welle | F24H 1/06 |
| 9,599,366 | B2 * | 3/2017 | Hoffert | F24H 3/00 |
| 2002/0085921 | A1 * | 7/2002 | Gram | F04B 15/08 417/53 |
| 2003/0070445 | A1 * | 4/2003 | Kasagi | F25B 13/00 62/238.7 |
| 2005/0126220 | A1 * | 6/2005 | Ward | F17C 9/02 62/625 |

OTHER PUBLICATIONS

Fleet Cryogenics, Inc. LNG Vaporization Trailer (2013 print-out from Website).
Prometheus Energy Drilling with LNG (2013 print-out from Website).
Cudd Energy Services brochure, "Industrial Nitrogen" (2008).
Chart LNG Mobile ReGasification Trailer (2013 print-out from Website).

* cited by examiner

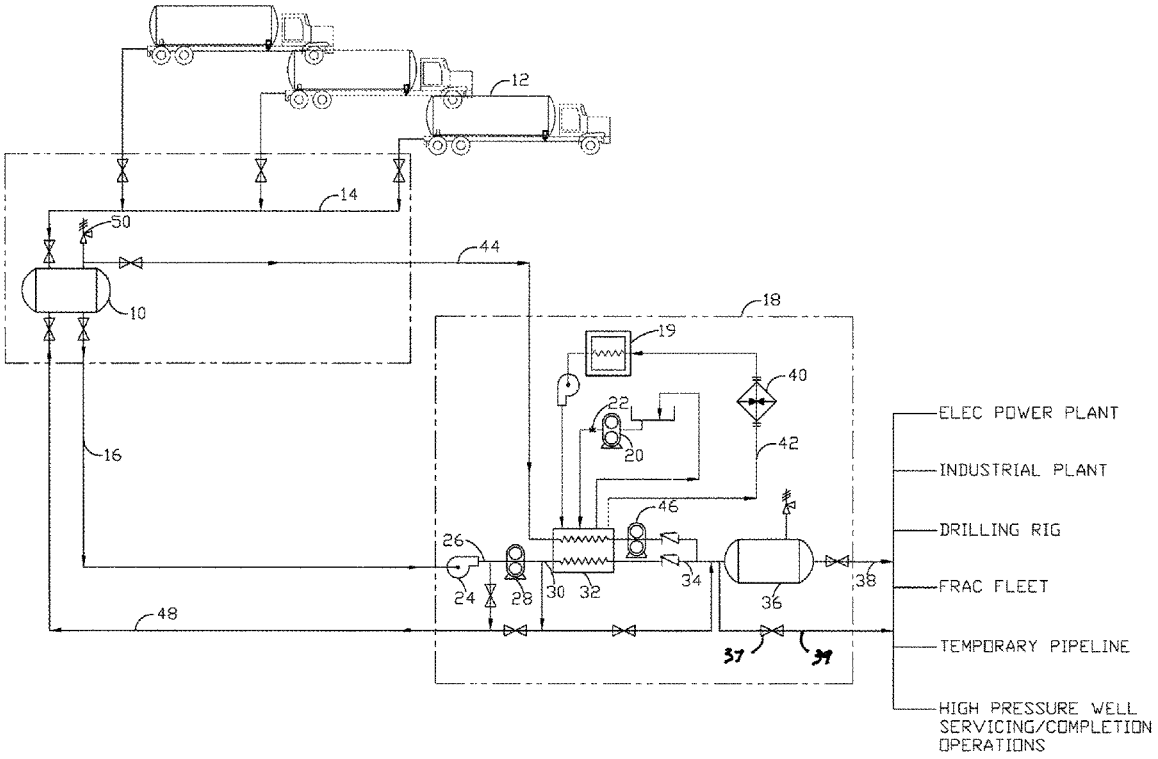
12
14
50
44
10
18
19
40
22
20
42
16
46
26
24
28
30
32
34
36
38
48
37
39
ELEC POWER PLANT
INDUSTRIAL PLANT
DRILLING RIG
FRAC FLEET
TEMPORARY PIPELINE
HIGH PRESSURE WELL SERVICING/COMPLETION OPERATIONS

LNG VAPORIZATION

BACKGROUND OF THE INVENTION

The present invention relates to the vaporization of cryogenic liquids. In more detail, the present invention relates to mobile vaporizers and methods for vaporizing LNG in sufficient volume and pressure to enable the use of the vaporized natural gas as a fuel source or in applications in which large quantities of vaporized LNG/compressed natural gas (CNG) are needed, for instance, for internal combustion engines or gas turbines operating at high horsepower, for electrical power generation during periods of peak demand, to displace other fuels such as oil or coal as fuel for power generation, and for well servicing applications utilizing CNG.

Recent increases in the cost of diesel fuel and changes in regulations governing the emissions from diesel engines have motivated the operators of diesel fleets to investigate the use of alternative fuels. The price advantage and availability of natural gas make it one of several alternative fuels currently under consideration as a substitute or at least a supplement to diesel fuel (see, for instance, M. Howe, "Mining Majors Ponder Switch to LNG in Bid to Cut Costs," http://designbuildsource.com.au/mining-majors-ponder-switch-to-lng-a-bid-to-cut-costs (Apr. 13, 2013)). In addition to the 30-40% price advantage, the ease of transport, and the cleaner emissions, natural gas has the advantage of performing in a manner similar to diesel in many applications and is therefore a focus of major diesel engine manufacturers. For example, Caterpillar is already offering natural gas-powered products such as mining trucks and locomotives, as well as bi-fuel conversion kits for existing Caterpillar diesel engines. Further, after-market component manufacturers such as American Power Group, Inc. are delivering bi-fuel conversion kits allowing various makes of existing engines to run on a mix of diesel and natural gas. For these same reasons, and because of the need for on-site natural gas, sometimes in remote locations away from the existing pipeline grid, natural gas is of interest as a fuel source and for well service applications in oil and gas production and as an alternative fuel source in the power generation industry. Baker-Hughes, Halliburton and other oilfield services players have recently announced initiatives to convert diesel-fueled drilling rigs and frac fleets to natural gas, and one Canadian natural gas producer reported savings of approximately $11 million in fuel costs in 2011 by using natural gas as a fuel source for its rigs.

Despite the cost savings and significantly decreased emissions, there are barriers to the widespread use of natural gas in such applications as the oilfield. Although natural gas can be transported to locations remote from the existing pipeline grid and stored in large quantity as liquefied natural gas (LNG), the LNG must be vaporized for use at the remote site. Vaporization of cryogenic liquids, and specifically, LNG vaporization is known in the art. By way of example, mobile LNG vaporizers are operated and/or sold by Eleet Cryogenics, Inc. (Bolivar, Ohio), Chart Industries, Inc. (Garfield Heights, Ohio), Prometheus Energy (Houston, Tex.), INOXCVA (Houston, Tex.) and others. In their most basic form, LNG vaporizers consist of ambient air heat exchangers equipped with the necessary valves and piping to receive the LNG from a reservoir and output the gas to the on-site equipment. Other types of vaporizers produce the heat required to vaporize LNG with electrically-powered heaters (one of the Chart Industries vaporizers utilizes an electric heater, for instance) or a fired heat source such as a burner (for instance, a Prometheus Energy vaporizer that circulates heated water through a heat exchanger for vaporizing the LNG).

However, the technology of the LNG vaporizers currently in use is an obstacle that prevents widespread use of LNG as a fuel source in such applications as the oilfield in which large volumes of natural gas are required to meet on-site energy needs. So far as is known, for instance, LNG mobile ambient vaporizers currently in use in the oilfield produce about 500-3000 standard cubic feet/min. of natural gas output at about 60 psi. The heat exchangers of such vaporizers require a large surface area to extract sufficient ambient heat for vaporizing LNG, thus requiring that the vaporizer have a large footprint, and the efficiency of such vaporizers is dependent on ambient air temperature. Further, ice build-up on the heat exchanger surface area imposes limits on the number of hours the vaporizer can operate and overall vaporizing efficiency. One way to overcome this ice build-up problem is to switch between multiple vaporizers, but using multiple vaporizers further increases the overall footprint of the vaporizer and limits the mobility of the vaporizer such that moving the vaporizer from one site to another may require multiple truckloads and over-the-road weight and height special permits. Electric type vaporizers such as those provided by Chart Industries, Inc. and INOXCVA are advertised as being capable of approximately 500 to 1000 SCFM at pressures of about 60 psi. This type of vaporizer is typically an integral component of an LNG transport tanker and requires an electrical source on-site, and such power sources are not always available at some sites such as hydraulic fracking locations. Further, multiple vaporizers of this type are needed on locations requiring high LNG flow such that overall footprint is large and mobility is compromised by the need for multiple truck loads to move the vaporizer(s) from site to site. By way of actual example, the above-described Prometheus Energy vaporizer is said to produce flow rates of about 250,000 scfh at approximately 60 psi. However, such vaporizers require a fired fuel source, typically a burner/boiler, that must be located at least 50-100 feet away from the LNG source, which is a limiting factor in some tight locations and could present safety concerns.

The modest pressure and rate output of these known/existing vaporizers, and other limiting factors, result in part from the need to move the vaporizer from one site to another, which imposes size and weight limitations on the vaporizer, and the need to limit the on-site footprint while maximizing the flexibility of locating the vaporizer in tight locations (the latter being of particular concern where a fired source is used as a source of heat), impose restrictions on the overall utility of known/existing vaporizers. So far as is known, no currently available LNG vaporizer (other than those that are part of a permanent installation and that require substantial capital outlay, for instance, at a natural gas-fired electric (or dual fuel) power generation plant) capable of overcoming these limitations and restrictions that outputs natural gas at high enough pressure and in sufficient volume for use as a fuel source for such high power applications as a fleet of ten or more on-site frac pumpers operating at the high horsepower required to pump fluids through a horizontal wellbore at the pressures needed for fracturing a hydrocarbon formation. To further illustrate, in recent years, manufacturers of bi-fuel kits that allow existing diesel engines that run on nearly 70/30 mix of diesel and natural gas, and new engine manufacturers, are developing new natural gas and bi-fuel engines that are even lighter, smaller in size and capable of producing higher horsepower than currently available.

Despite on-going engine development efforts, as far as is known, no mobile LNG vaporizers are available that are not encumbered by limitations of size, weight, mobility, flow capacity, and particularly the ability to output CNG at the high pressures sufficient to power even a small fleet of frac pumpers running on a 70/30 mix of diesel and LNG. For these same reasons, so far as is known, existing vaporizers are incapable of outputting gas at pressures sufficient to allow the mobile LNG vaporizer and the LNG storage tanks (mobile or stationary) to be located at a distance of several hundred feet, or even several miles, away from the site where the natural gas flow is needed. A mobile vaporizer capable of delivering compressed natural gas at pressures higher than existing vaporizers can also provide advantages not possible with existing mobile vaporizers in addition to allowing the vaporizer to be located a safe distance away from the site where natural gas is needed.

A significant increase in maximum vaporizing capacity (up to 540,000 scfh) and output pressure could enable an LNG vaporizer to be used for new applications including planned natural gas supply interruptions and even as a supply source for several miles of temporary pipeline. In the oilfield, mobile vaporizers that could produce sufficient pressure and volume to power a fleet of frac pumpers having 2000-2500 horsepower diesel engines equipped with bi-fuel kits, allowing those engines to run on nearly a 30/70 mix of diesel and LNG, would enable the above-described advantages of the small footprint needed in tight remote locations and the need to locate the LNG vaporizer and LNG source remotely from the frac fleet. Again, the oilfield provides just one example of an application in need of vaporizers with higher output than currently available; there are many other applications including on-demand and off the grid power generation, temporary heating, and offshore oil rigs.

It is therefore an object of the present invention to provide an LNG vaporizer that outputs sufficient volumes of vaporized natural gas at sufficient pressure to provide fuel for, for instance, a fleet of on-site frac pumpers running on natural gas or a mix of diesel and natural gas.

It is another object of the present invention to provide an LNG vaporizer small and light enough to be moved from location to location that outputs high volumes of vaporized natural gas at high pressure; specifically, it is contemplated that the LNG vaporizer of the present invention mounts on a trailer, tractor, or skid weighing less than about 60,000 pounds so that the vaporizer is road legal and load permits are not required to move the vaporizer on public roads.

As noted above, another problem with existing LNG vaporizers is the relatively low pressure, usually about 40 to 60 psi, of the natural gas output from the vaporizer. Most known LNG vaporizers output vaporized natural gas at about 40 psi (because 40 psi can be achieved by expansion from heat), but in an application in which large volumes and/or high pressure LNG is required (such as the fleet of frac pumpers described above and/or in applications in which the LNG supply and vaporizer must be located remotely from the internal combustion engine for safety or other reasons), pressures in the 500 to 2500 psi range, or higher, may be required. It is therefore also an object of the present invention to provide an LNG vaporizer having the flexibility of being capable of outputting natural gas at low and high pressures depending upon the application/location and demand.

Other objects, and the many advantages of the present invention, will be made clear to those skilled in the art in the following detailed description of the preferred embodiment (s) of the invention and the drawing(s) appended hereto. Those skilled in the art will recognize, however, that the embodiment(s) of the present invention that are described herein are only examples of specific embodiment(s), set out for the purpose of describing the making and using of the present invention, and that the embodiment(s) shown and/or described herein are not the only embodiment(s) of an apparatus and/or method constructed and/or performed in accordance with the teachings of the present invention. Further, although described herein as having particular application to certain oilfield operations, as noted above, those skilled in the art who have the benefit of this disclosure will recognize that the present invention may be utilized to advantage in many applications (gas turbine and pipeline commissioning and testing, peak electric generation, emergency or planned natural gas supply interruptions, well servicing and completion operations, and many others) in which large quantities of natural gas are being used as a fuel source or for other purposes where high pressure natural gas is required, the present invention being described with reference to the oilfield for the purpose of exemplifying the invention, and not with the intention of limiting its scope.

SUMMARY OF THE INVENTION

The present invention meets the above-described objects by providing an LNG vaporizing system including an internal combustion engine with engine coolant fluid such as glycol circulating in the engine block to absorb the heat rejected by the engine and that produces exhaust gases as another means of heat rejection, the engine being artificially loaded by driving hydraulic pumps for pumping hydraulic fluid through the restricted orifice of a sequencing valve, comprising an LNG source, booster pump and/or reciprocating (simplex, duplex, triplex, or even quintaplex) pump having an input connected to the LNG source and an output, and a first heat exchanger for receiving LNG from the reciprocating pump. Heat is transferred from the hydraulic fluid and from the engine coolant to the LNG passing through the first heat exchanger so that compressed natural gas is output from the first heat exchanger and a second heat exchanger is provided through which the engine coolant passes, and where the heat from the engine exhaust stream is transferred to the engine coolant.

In another aspect, the present invention provides a method of vaporizing LNG comprising the steps of increasing the heat produced by an internal combustion engine by artificially loading the internal combustion engine by using the internal combustion engine to drive hydraulic pump(s) and forcing the hydraulic pump-pressurized discharge fluid flow through a restricted orifice thus forcing the engine to burn more fuel and increasing the temperature of the hydraulic fluid, engine coolant, and engine exhaust, and routing LNG from an LNG source to a booster or the suction/intake of a reciprocating pump. The LNG is pumped from the reciprocating pump through a heat exchanger and heat is transferred from the hydraulic fluid and the engine coolant to the LNG. Heat is also transferred from the engine exhaust to the engine coolant.

BRIEF DESCRIPTION OF THE DRAWINGS

FIG. 1 is a schematic, or layout, diagram of a system incorporating an LNG vaporizer constructed in accordance with the teachings of the present invention.

DETAILED DESCRIPTION OF THE PREFERRED EMBODIMENT(S)

Referring to FIG. 1, LNG is provided to a storage tank 10 by one or more LNG transport trucks 12 through a loading manifold 14, all constructed in accordance with known LNG storage and handling systems. LNG is output from storage tank 10 through supply line 16 to the LNG vaporizer of the present invention, indicated generally at reference numeral 18, that is itself powered by an internal combustion engine 19 that may be diesel or natural gas powered, or that may be powered on a mix of diesel and natural gas. The internal combustion engine 19 of LNG vaporizer 18 is "artificially" loaded by driving a hydraulic pump 20 that pumps hydraulic fluid through the restricted orifice 22 of a sequencing valve, the engine 19 producing more heat that is "captured" in the engine coolant as engine 19 works harder and burn more fuel to push hydraulic fluid through valve orifice 22. In the embodiment described herein, the internal combustion engine 19 of LNG vaporizer 18 provides three heat sources, the hydraulic fluid, the engine exhaust, and the high temperature engine coolant, and all three heat sources are used to advantage in the method and apparatus described below.

The engine 19 of LNG vaporizer 18 also powers a hydraulically-driven booster pump 24 provided for the purpose of feeding LNG through line 26 to the suction side of a hydraulically-driven reciprocating pump 28, which may be a simplex, duplex, triplex, or other multiple-cylinder pump. Those skilled in the art who have the benefit of this disclosure will recognize that the booster pump 24 is not always utilized, and may not even be needed, in installations in which the LNG source, such as LNG tank 10 or transports 12, provides LNG at sufficient pressure to the suction side of reciprocating pump 28. For instance, some LNG tanks provide LNG at sufficient pressure that a booster pump is not needed and some LNG tanks are provided with internal pumps that provide LNG at the pressure needed at the suction side of reciprocating pump 28. Reciprocating pump 28 builds sufficient pressure in the input line 30 to heat exchanger 32 to overcome the 200-1000 psi pressure drop characteristic of passage through a heat exchanger with the result that the natural gas output through line 34 to the compressed natural gas (CNG) tank 36 or other equipment (see the description of valve 37 and line 39, below) can be in the 400-10,000 psi range, more particularly, 500-2500 psi, to overcome further pressure drop or resistance downstream depending upon the needs of the particular installation or application. As illustrated in FIG. 1, the output line 38 from CNG tank 36 is connected to an industrial plant, electric power plant, temporary pipeline, a well head for applications in which the vaporized natural gas is utilized at volumes and pressures sufficient for well servicing and/or well completion operations (for instance, at pressures high enough to break the rupture disks used to isolate one zone from another), the internal combustion engines of a drilling rig or frac fleet, or any of the many other applications and/or installations in which natural gas is used to advantage. As also shown in FIG. 1, output line 36 is provided with a by-pass or diverter valve 37 and line 39 for routing the vaporized natural gas directly to the industrial plant, electric power plant, or any of the many other applications and/or installations in which large volumes of pressurized natural gas are used to advantage.

As noted above, the internal combustion engine 19 of LNG vaporizer 18 outputs three heat sources, and heat exchanger 32 receives inputs from two of those sources, the engine coolant at temperatures typically ranging between about 170-190 degrees F. and the hydraulic fluid used to load engine 19 at temperatures typically ranging between about 160-200 degrees F. The third heat source, namely the engine exhaust, enters a second heat exchanger 40 with the engine coolant in the line 42 at temperatures ranging between about 110-170 degrees F. as the coolant is returned to engine 19 from heat exchanger 32. The LNG flow passing in line 30 through heat exchanger 32 strips enough heat from the engine coolant in heat exchanger 32 that engine coolant is returned to the engine through second heat exchanger 40 so that coolant heated by the engine exhaust in second heat exchanger 40 is heated to the coolant temperature specified for the particular engine 19 (typically in the 160-180 degree F. range).

No matter how well the LNG storage tank 10 and/or transports 12 is/are insulated, some vapor is lost from tank 10/transports 12 which is typically vented to the atmosphere. The present invention provides a means to collect the vapor from the LNG storage tank 10 and LNG transport 12 and direct that collected vapor to vapor supply line 44, thus preventing the vapor/gas from being vented to the atmosphere and preserving the natural gas for meaningful use. Vapor supply line 44 is connected into output line 34 after being routed through heat exchanger 32, a relatively small compressor 46 being provided to insure flow from line 44 into the relatively high pressure output line 34 in the event the expansion occurring within heat exchanger 32 does not provide adequate pressure to overcome the pressure in line 34. Those skilled in the art who have the benefit of this disclosure will recognize that under normal operating conditions, compressor 46 will run only intermittently.

A return line 48 and appropriate valves (not numbered) are provided in each section of the lines connecting storage tank 10 to CNG tank 36, as is a safety valve 50 and appropriate controls (not shown), all as known in the art. Likewise, appropriate controls, instrumentation, and sensors/monitors are provided to insure safe operation of the LNG vaporizer of the present invention.

Those skilled in the art who have the benefit of this disclosure will also recognize that changes can be made to the component parts of the present invention without changing the manner in which those component parts function and/or interact to achieve their intended result. All such changes, and others that will be clear to those skilled in the art from this description of the preferred embodiment(s) of the invention, are intended to fall within the scope of the following, non-limiting claims.

What is claimed is:

1. An LNG vaporizing system including an internal combustion engine and circulating engine coolant for absorbing heat produced by operating the engine, the engine being loaded by driving a hydraulic pump that pumps hydraulic fluid through a restricted orifice, comprising:

an LNG source;

a reciprocating pump having an input and an output, the input being connected to said LNG source;

a first heat exchanger for receiving LNG from said reciprocating pump, the heat from the hydraulic fluid and the heat from the circulating engine coolant being transferred to LNG output from said reciprocating pump to vaporize the LNG; and a second heat exchanger through which the circulating engine coolant passes, the heat from the exhaust produced by operating the internal combustion engine being transferred from the heated engine exhaust to the engine coolant passing through said second heat exchanger.

2. The LNG vaporizing system of claim 1 wherein the engine coolant passes through said second heat exchanger after passing through said first heat exchanger.

3. The LNG vaporizing system of claim 1 additionally comprising a booster pump for raising the pressure of the input to said reciprocating pump.

4. The LNG vaporizing system of claim 1 wherein said LNG source is provided with a vapor supply line connected to the LNG output, said vapor supply line passing through said first heat exchanger.

5. The LNG vaporizing system of claim 1 additionally comprising a CNG tank connected to the output from said first heat exchanger.

* * * * *